US005124194A

United States Patent [19]

Kawano

[11] Patent Number: 5,124,194

[45] Date of Patent: * Jun. 23, 1992

[54] HOT-MELT-ADHESIVE, MICRO-FIBER-GENERATING CONJUGATE FIBERS AND A WOVEN OR NON-WOVEN FABRIC USING THE SAME

[75] Inventor: Michinori Kawano, Kyoto, Japan

[73] Assignee: Chisso Corporation, Ohsaka, Japan

[ * ] Notice: The portion of the term of this patent subsequent to Oct. 30, 2007 has been disclaimed.

[21] Appl. No.: 555,241

[22] Filed: Jul. 19, 1990

[51] Int. Cl.[5] ..... D02G 3/02

[52] U.S. Cl. ..... 428/224; 428/299; 428/373; 428/374; 428/394; 428/395; 428/903

[58] Field of Search ..... 428/224, 288, 290, 299, 428/373, 374, 392, 394, 395, 903

[56] References Cited

U.S. PATENT DOCUMENTS

| | | | |
|---|---|---|---|
| 4,008,344 | 2/1977 | Okamoto et al. | 427/307 |
| 4,243,713 | 1/1981 | Worrall et al. | 428/245 |
| 4,350,006 | 9/1982 | Okamoto et al. | 57/250 |
| 4,381,335 | 4/1983 | Okamoto | 428/373 |
| 4,477,516 | 10/1984 | Sugihara et al. | 428/296 |
| 4,663,221 | 5/1987 | Makimura et al. | 428/224 |
| 4,818,587 | 4/1989 | Ejima et al. | 428/198 |
| 4,966,808 | 10/1990 | Kawano | 428/224 |

*Primary Examiner*—George F. Lesmes
*Assistant Examiner*—Christopher Brown
*Attorney, Agent, or Firm*—Fay, Sharpe, Beall, Fagan, Minnich & McKee

[57] ABSTRACT

Hot-melt-adhesive, micro-fibers-generating conjugate fibers (A), hot-melt-adhesive, micro-conjugate fibers (B) and a woven or non-woven fabric using the former fibers (A) are provided. The former fibers (A) have a sufficient tenacity and afford a stabilized spinability. The former fibers (A) have at least one conjugate portion of the conjugate fibers with an island-in-sea structure exposed onto the surface of the conjugate fiber. The sea part in the island-in-sea structure being removed by means of a solvent or the like, with the remaining island part having a fineness of 1 d or less. The other conjugate portion being a fiber composed of a thermoplastic resin having a melting point lower than that of the resin constituting the super-fine fibers and having 0.5 d or more, and the conjugate fibers having 1 d or more in total. The latter fibers (B) are those obtained by removing the sea component from the former fibers (A). The woven or non-woven fabric having micro-fibers prepared by removing the sea component from a woven or non-woven fabric using, the former fibers (A); the former fibers (A) and normal hot-melt-adhesive conjugate fibers; or the former fibers (A) applied thereonto or by subjecting the above formber fibers (A) after removal of the sea component to heat treatment.

7 Claims, 1 Drawing Sheet

HOT-MELT-ADHESIVE, MICRO-FIBER-GENERATING CONJUGATE FIBERS AND A WOVEN OR NON-WOVEN FABRIC USING THE SAME

BACKGROUND OF THE INVENTION

1. Field of the Invention

This invention relates to hot-melt-adhesive, micro-fiber-generating conjugate fibers and a woven or non-woven fabric using the same. More particularly, it relates to hot-melt-adhesive, micro-fiber-generating conjugate fibers from which hot-melt-adhesive, micro-fibers are generated by removing a part of components constituting the conjugate fibers, and a woven fabric or a non-woven fabric using the conjugate fibers.

2. Description of the Related Art

Recently, as high-class and diversified clothes have been dsired, improvement in feeling of fibers by way of making fibers very fine has been attempted, and further as use applications of synthetic paper, non-woven fabric, etc. are developed, a process for producing micro-fibers has been also desired to be developed. Further, since a new application of micro-fibers to a wiper, etc. was found, improvement in its properties has been attempted. Among micro-fibers-generating fibers, those of the so-called island-in-sea type fibers are very useful and a number of products using the same are commercially available.

Among the island-in-sea type, micro-fibers-generating fibers, particularly those wherein the island-in-sea structure is relied on a polymer blend, as disclosed in Japanese patent publication No. Sho 47-37648/1972, are prepared by blending different kinds of polymers constituting the respective components of island and sea, melt-spinning the resulting blend and removing the sea component with a solvent to leave only the island component. In such fibers, the blending proportion of the sea component should be large for keeping the independence of the island component. However, the sea component is used for temporarily binding a bundle of micro-fibers, and is to be finally removed. Hence the binding component cannot be a reinforcing component. So, the micro-fibers-generating fibers of this type could not have a high tenacity. Further, the bundle of micro-fibers as a remaining island component obtained by removing the sea component from the island-in-sea type micro-fibers-generating fibers has a low tenacity, so it is impossible to make the lengths of the micro-fibers uniform.

Further, as to the spinnability of fibers obtained by subjecting different kinds of polymers to composite spinning so as to give an island-in-sea structure as disclosed in Japanese patent application laid-open No. Sho 60-21904 (1985), since the spinnability of the sea component is very often inferior, the spinnability of the island-in-sea type fibers is inferior, too. Further, in the case of fibers of which the components are of a polymer blend, since polymers having different properties from each other are blended, a satisfactory spinning stability cannot be obtained. So, the polymer is extruded from spinning nozzles in a thick and fine form and the extrudate is liable to break like raindrops.

SUMMARY OF THE INVENTION

The object of the present invention is to provide hot-melt-adhesive micro-fibers-generating fibers having a tenacity enough for practical uses, and a stabilized spinnability, and a woven or non-woven fabric having a unique soft feeling using the same.

The present inventors have made extensive research in order to solve the above-mentioned problem of the micro-fibers-generating fibers, and as a result have found that the hot-melt-adhesive, micro-fibers-generating fibers composed of the following conjugate fibers attain the above object, at least one conjugate portion of the conjugate fibers having an island-in-sea structure exposed onto the surface of the conjugate fibers, the island part of the structure being made into micro-fibers of 0.1 d or less, the other conjugate portion not having the island-in-sea structure (hereinafter referred to as the other portion) being made into a fiber of 0.5 d or more composed of a thermoplastic resin having a melting point lower than that of a resin constituting the island part, and the micro-fibers of 0.1 d or less composed of the island component are generated in the vicinity of the fiber of 0.5 d or larger by removing the sea part of the conjugate fiber, thereby having the tenacity of the micro-fibers-generating fibers retained by the fiber composed of the other portion, and having a unique feeling of the microfibers exhibited therein. By forming a woven or non-woven fabric from the fibers and heat-treating the resulting fabric at a temperature lower than the melting point of the micro-fibers and higher than the melting point of the other portion, the aimed woven or non-woven fabric is obtained.

The present invention has the following features (1) to (5):

(1) Hot-melt-adhesive micro-fibers-generating conjugate fibers, wherein said conjugate fiber has a fineness of one denier or more, at least one conjugate component of said conjugate fiber has an island-in-sea structure and exposed on the surface of said conjugate fiber, the other conjugate component of said conjugate fibers composes of a thermoplastic resin having a melting point lower than that of the resin constituting the island part of said island-in-sea structure and has a fineness of 0.5 denier or more, the sea part of said conjugate component is removable by a solvent treatment, and each island part of said conjugate structure after removing the sea part has a fineness of 0.1 denier or less.

(2) A woven or non-woven fabric containing micro-fibers, obtained by removing from a woven or non-woven fabric prepared by using said microfibers-generating conjugate fibers as set forth in (1), the sea part contained in said conjugate fibers.

(3) A woven or non-woven fabric according to (2), wherein said woven or non-woven fabric prepared by using said conjugate fibers is subjected to a heat-treatment for hot-melt adhesion before or after removing said sea part from said woven or non-woven fabric.

(4) A woven or non-woven fabric containing micro-fibers, obtained by removing the sea part contained in said conjugate fibers from a woven or non-woven fabric prepared by using said micro-fibers-generating conjugate fibers as set forth in (1) and normal hot-melt-adhesive fibers.

(5) A woven or non-woven fabric according to (4), wherein said woven or non-woven fabric prepared by using said conjugate fibers is subjected to a heat-treatment for hot-melt adhesion before or after removing said sea part from said woven or non-woven fabric.

(6) A woven or non-woven fabric containing micro-fibers, obtained by removing the sea part contained therein from a woven or non-woven fabric prepared by applying a binder to the hot-melt-adhesive micro-fibers-generating conjugate fibers as set forth in (1).

(7) Hot-melt-adhesive conjugate fibers containing micro-fibers, obtained by removing the sea part of the conjugate component of the hot-meltadhesive micro-fibers-generating conjugate fibers as set forth in (1).

In these figures, numeral 1 represents one conjugate component, 2 represents island part, 3 represents sea part and 4 represents the other conjugate component.

DETAILED DESCRIPTION OF PREFERRED EMBODIMENTS

Figure 1:
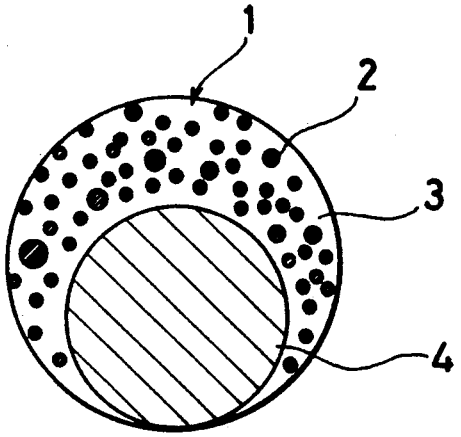
FIG. 1 shows a cross-section of micro-fibers-generating conjugate fibers of side-by-side type.
Figure 2:
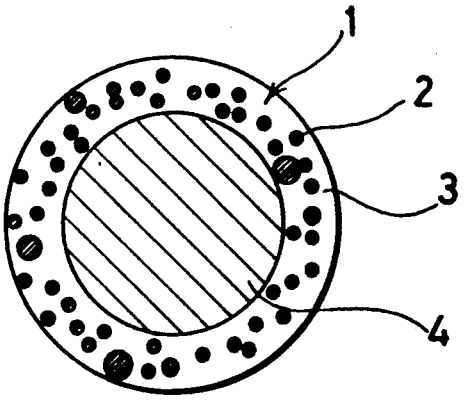
FIG. 2 shows a cross-section of micro-fibers-generating conjugate fibers of sheath-and-core type.

The configuration of the conjugate fibers in the present invention has no particular limitation as far as the component having an island-in-sea structure as a component generating micro-fibers is exposed on the surface of the conjugate fibers. Examples of such conjugate fibers are shown in FIGS. 1 and 2. Referring to FIG. 1, one component 1 and the other component 4 constitute a side-by-side type conjugate fiber. The component 1 has an island-in-sea structure. In FIG. 2, a sheath component 1 and a core component 4 constitute a sheath-and-core type conjugate fiber. In these figures, the island-in-sea structure consists of a sea part 3 and an island part 2.

Examples of resins usable as the island part 2 are polyolefins such as polyethylene, polypropylene, etc., polyamides such as nylon 6, nylon 66, etc. and thermoplastic polyesters such as polyethylene terephthalate, polybutylene terephthalate, etc. As for the other component 4, resins having a melting point lower than that of the resins used as the island part may be used among the resins exemplified as those used as the island component. Further, examples of resins usable as the sea part 3 are those which are removable without having a bad effect upon components other than the sea part 3, such as partially saponified polyvinyl alcohol (water-soluble), copoly(ethylene-terephthalate-5-sodium sulfoisophthalate) hydrolyzable with alkalies, etc.

As a process for producing micro-fibers-generating conjugate fibers, any conventional process for spinning a conjugate fiber of sheath-core type or side-by-side type may be employed, provided that at least one of the conjugate components of the fiber has an island-in-sea structure and is exposed on the surface of the conjugate micro-fibers-generating fiber. The other conjugate component 4 of the fiber has a normal structure. For obtaining the island-in-sea structure, a process of subjecting both the polymers for island and sea parts to blending, as disclosed in Japanese patent publication No. Sho 47-37648/1972, a process of dividing one component flow of resin into a plurality of flows and combining the flows with the other component flow of resin to form a conjugate flow of resin to a spinneret, as disclosed in Japanese patent application laid-open No. Sho 60-21904/1985, etc. are exemplified.

When the sea part in the micro-fibers-generating conjugate fibers according to the present invention is removed therefrom, it is possible to obtain the hot-melt-adhesive fibers containing micro-fibers. Further, when the micro-fibers-generating conjugate fibers are made up into a woven fabric or a nonwoven fabric, and removed therefrom the sea component, it is possible to obtain a woven or a non-woven fabric each containing micro-fibers.

In order to remove the sea part, a material which dissolves or hydrolyzes the resin of the sea part may be used. In the case where the resin is water-soluble, water or hot water is used, and in the case where the resin is hydrolyzable, an alkali solution may be used. Those which have no bad effect upon components other than the sea component are preferable.

The micro-fibers-generating conjugate fibers of the present invention are, optionally combined with known normal hot-melt-adhesive fibers, formed into a woven or a non-woven fabric, followed by subjecting the woven or non-woven fabric to hot-melt-adhesion treatment at a temperature higher than melting point of the lower melting component of the hot-melt-adhesive fibers or the other component of the micro-fibers-generating conjugate fibers, and at a temperature lower than the melting point of the higher melting component of the hot-melt-adhesive fibers or the melting point of the sea part in the micro-fibers-generating conjugate fibers, to form a woven or a non-woven fabric, and thereafter removing the sea component, whereby it is possible to obtain a woven or a non-woven fabric having micro-fibers. In addition, the removal of the sea component may be carried out prior to the hot-melt-adhesion.

The micro-fibers-generating conjugate fibers of the present invention may have a binder applied thereonto, followed by removing the sea component before or after forming the resulting material into a woven or a non-woven fabric, whereby it is possible to obtain a woven or a non-woven fabric each having micro-fibers. As such a binder, known binders such as aqueous latex, etc. may be used.

Further, as a means for forming such a woven fabric or a non-woven fabric, known interlacing or carding machines, wet or dry non-woven fabric-producing apparatus may be used.

The present invention will be described in more detail by way of Examples, but it should not be construed to be limited thereto.

EXAMPLE 1

A blend of a thermoplastic polyvinyl alcohol (polymerization degree 300; saponification degree 62%) with a polypropylene (MFR (melt flow rate)=35) in a ratio by weight of 1:1 as an island-in-sea component and a high density polyethylene (MI (melt index)=25) as the other component were each fed into a spinneret of side-by-side type having spinning holes of 0.4 mm in diameter (the total number of the spinning holes: 198) at rates of 60 ml/min. and 90 ml/min., respectively, and extruded from the spinneret at a spinning temperature of 200° C., followed by drawing of the extruded fibers according to spunbonding process at a rate of 560 m/min. to obtain a fleece of hot-melt-adhesive micro-fibers-generating conjugate fibers of side-by-side type having a finess of 9.7 denier. The resulting fleece was made up into a non-woven fabric by means of an embossing roll (linear pressure: 20 Kg/cm) at 120° C., followed by removing the sea component therein with hot water at 80° C. to obtain a non-woven fabric containing micro-fibers (basis weight: 100 g/m$^2$). This non-woven fabric was observed by means of a microscope. As a result, polyethylene fibers having a fineness of 5.5 denier were surrounded by the generated micro-fibers had a fineness of 0.0002 to 0.1 denier (d). Further, the non-woven fabric exhibited a tensile break strength of 4.2 Kg in a width of 5 cm and a test length of 10 cm.

In addition, the above mentioned fleece was made up into a non-woven fabric (basis weight: 60 g/m$^2$) in the same manner as described above. This non-woven fabric exhibited a tensile break strength of 2.5 Kg in a width of 5 cm and a test length of 10 cm.

EXAMPLE 2

A blend of a thermoplastic polyvinyl alcohol (polymerization degree: 400 and saponification degree: 62%) with a polypropylene (MFR=20) in a ratio by weight of 1:1, as a sheath component resin, and a high density polyethylene (Melt Index of 25) as a core component resin, at a rate of 133 ml/min., respectively, were each fed into a spinneret having spinning holes of 0.6 mm in diameter (the total number of the spinning holes: 350), followed by extrusion from the spinneret at a spinning temperature of 220° C. and drawing at a rate of 265 m/min. to obtain micro-fibers-generating conjugate fibers of sheath-and-core type.

The thus obtained conjugate fibers were stretched to 4 times the original length, followed by cutting the stretched fibers into staples of 51 mm long having a fineness of 5.5 denier and carding the staples to obtain a web.

This web was made up into a non-woven fabric by means of an embossing roll heated at 125° C., followed by washing the fabric with hot water at 80° C. to obtain a non-woven fabric containing polyethylene fibers of 2.4 denier and micro-fibers of polypropylene of 0.0002 to 0.1 d and a basis weight of 55 g/m$^2$. This non-woven fabric exhibited a tensile break strength of 3.3 Kg in a width of 5 cm and a test length of 10 cm (in the machine direction).

In addition, the above mentioned staple was made up into a non-woven fabric (basis weight: 60 g/m$^2$) in the same manner as described above. This non-woven fabric exhibited a tensile break strength of 4.7 Kg in a width of 5 cm and a test length of 10 cm (in the machine direction).

EXAMPLE 3

The stretched yarn obtained in Example 2 was cut into staples of 6 mm long, followed by subjecting the staples to wet paper-making (the sea component being removed during the paper-making), and heat-treating at 145° C. to obtain a nonwoven fabric having a basis weight of 100 g/m$^2$. This nonwoven fabric exhibited a tensile break strength of 0.9 Kg in a width of 5 cm and a test length of 10 cm (in the machine direction).

EXAMPLE 4

A web obtained by carding a hot-melt-adhesive conjugate fiber staple (single filament fineness: 2 d, fiber length: 51 mm) composed of polypropylene as a core component and polyethylene as a sheath component was treated in a hot air oven at 140° C. to obtain a normal non-woven fabric having a basis weight of 30 g/m$^2$. The strength of this non-woven fabric was 10 Kg/5 cm. A web obtained by carding the staple obtained in Example 2 was laid on the above-mentioned non-woven fabric, followed by heat-pressing by means of embossing rolls at 125° C. under a linear pressure of 20 Kg/cm, and washing the resulting laminate with hot water at 80° C. to obtain a non-woven fabric of a basis of 80 g/m$^2$, having micro-fibers on one side thereof. This laminated nonwoven fabric had a very soft feeling and a gentle touch to skin caused by the side of micro-fibers and had a firm structure caused by the side of the normal non-woven fabric, and had a tensile break strength of 14.2 Kg/5 cm.

EXAMPLE 5

A web obtained by carding the staple prepared in Example 2 was subjected to water-needle-punching, simultaneously removing the sea component and obtaining entanglement of fibers, followed by impregnating the resulting material with an acrylic resin emulsion adhesive to obtain a non-woven fabric having micro-fibers of polypropylene having 0.0002 to 0.1 d. This non-woven fabric had a soft and smooth surface, the micro-fibers were fixed to the fabric with the adhesive without any fluffing-off, and the strength was 3.3 Kg/5 cm.

According to the present invention, the micro-fibers-generating conjugate fibers of the present invention comprise a portion having an island-in-sea structure from which portion micro-fibers of 0.1 d or less are generated, and the other portion composed of fibers 0.5 d or more and having a melting point lower than that of the micro-fibers. Thus, the conjugate fibers have a high break strength for micro-fibers-generating fibers and hence have a practically sufficient tenacity, and are possible to effect hot-melt-adhesion. Still further, in the case of production of the conjugate fibers, as composed with the case where only a portion having an island-in-sea structure from which portion micro-fibers are generated is spun, since the portion having an island-in-sea structure and the other portion having superior spinning properties are subjected to conjugate spinning in the present invention, the range of spinning conditions is broadened and a stable spinnability is obtained. Further, the woven or non-woven fabric obtained by using the hot-melt-adhesive micro-fibers-generating fibers has a unique soft feeling and touch due to the micro-fibers and a sufficient strength for practical use.

What we claim:

1. Hot-melt-adhesive micro-fibers-generating conjugate fibers, wherein
   - said conjugate fiber has a fineness of one denier or more,
   - at least one conjugate component of said conjugate fiber has an island-in-sea structure and exposed on the surface of said conjugate fiber,
   - the other conjugate component of said conjugate fibers composes a thermoplastic resin having a melting point lower than that of the resin constituting the island part of said island-in-sea structure and has a fineness of 0.5 denier or more,
   - the sea part of said conjugate component is removable by a solvent treatment, and
   - each island part of said conjugate structure after removing the sea part has a fineness of 0.1 denier or less.

2. A woven or non-woven fabric containing micro-fibers, obtained by removing from a woven or non-woven fabric prepared by using said microfibers-generating conjugate fibers as set forth in claim 1, the sea part contained in said conjugate fibers.

3. A woven or non-woven fabric according to claim 2, wherein said woven or non-woven fabric prepared by using said conjugate fibers is subjected to a heat-treatment for hot-melt adhesion before or after removing said sea part from said woven or non-woven fabric.

4. A woven or non-woven fabric containing micro-fibers, obtained by removing the sea part contained in said conjugate fibers from a woven or non-woven fabric prepared by using said micro-fibers-generating conjugate fibers as set forth in claim 1 and hot-melt-adhesive fibers.

5. A woven or non-woven fabric according to claim 4, wherein said woven or non-woven fabric prepared by using said conjugate fibers is subjected to a heat-treatment for hot-melt adhesion before or after removing said sea part from said woven or non-woven fabric.

6. A woven or non-woven fabric containing micro-fibers, obtained by removing the sea part contained therein from a woven or non-woven fabric prepared by applying a binder to the hot melt-adhesive micro-fibers-generating conjugate fibers as set forth in claim 1.

7. Hot-melt-adhesive conjugate fiber containing micro-fibers, obtained by removing the sea part of the conjugate component of the hot-melt-adhesive micro-fibers-generating conjugate fibers as set forth in claim 1.

* * * * *